US008484849B2

(12) United States Patent
Morisugi et al.

(10) Patent No.: US 8,484,849 B2
(45) Date of Patent: Jul. 16, 2013

(54) HAIR REMOVER

(75) Inventors: Kazuhiro Morisugi, Inukami (JP); Toshio Ikuta, Hikone (JP)

(73) Assignee: Panasonic Corporation, Osaka (JP)

( * ) Notice: Subject to any disclaimer, the term of this patent is extended or adjusted under 35 U.S.C. 154(b) by 359 days.

(21) Appl. No.: 12/883,817

(22) Filed: Sep. 16, 2010

(65) Prior Publication Data

US 2011/0072668 A1 Mar. 31, 2011

(30) Foreign Application Priority Data

Sep. 25, 2009 (JP) ..... 2009-220453

(51) Int. Cl.
*B26B 19/14* (2006.01)
*A45D 26/00* (2006.01)

(52) U.S. Cl.
USPC ..... 30/29.5

(58) Field of Classification Search
USPC ..... 30/29.5, 43.6, 346.51
See application file for complete search history.

(56) References Cited

U.S. PATENT DOCUMENTS 3,054,179 A * 9/1962 Reiser et al. ..... 30/29.5
3,085,328 A * 4/1963 Strike ..... 30/29.5
6,067,714 A 5/2000 Taylor et al.
7,152,323 B1 * 12/2006 Lin ..... 30/29.5
7,401,406 B2 * 7/2008 Morisugi et al. ..... 30/29.5
7,874,073 B2 * 1/2011 Ogawa et al. ..... 30/29.5
2005/0028369 A1 2/2005 Cocchiarella et al.
2006/0200991 A1 * 9/2006 Chan ..... 30/29.5
2007/0022605 A1 2/2007 Morisugi et al.
2011/0232096 A1 * 9/2011 Yabuuchi et al. ..... 30/29.5

FOREIGN PATENT DOCUMENTS

CN 1903528 A 7/2006
CN 1833833 A 9/2006
EP 1749622 A 2/2007
JP 07-313241 A 12/1995
JP 2007-29382 * 2/2007
JP 3161441 * 7/2010

OTHER PUBLICATIONS

Office action in related Chinese Patent Application No. 201010290025.1, dated Jul. 17, 2012.
International Search Report from corresponding Chinese patent application No. 1903528, dated Mar. 14, 2013.

* cited by examiner

*Primary Examiner* — Hwei C Payer
(74) *Attorney, Agent, or Firm* — Wolf, Greenfield & Sacks, P.C.; Randy J. Pritzker

(57) ABSTRACT

A hair remover including a cylindrical outer blade and an inner blade rotatably accommodated in the outer blade. The outer blade includes a side wall, a bend, and an upper wall that are continuous with each other. A first cutting edge is arranged on the upper wall and the side wall. The inner blade includes a second cutting edge arranged so as to clip hair in cooperation with the first cutting edge of the outer blade. The hair remover further includes a relief arranged on at least either one of the inner blade and the outer blade to prevent contact between the inner blade and the bend of the outer blade.

11 Claims, 8 Drawing Sheets

HAIR REMOVER

CROSS-REFERENCE TO RELATED APPLICATIONS

This application is based upon and claims the benefit of priority from prior Japanese Patent Application No. 2009-220453, filed on Sep. 25, 2009, the entire contents of which are incorporated herein by reference.

BACKGROUND

The present invention relates to a hair remover for trimming body hair such as nose hair.

Japanese Laid-Open Patent Publication No. 7-313241 describes a prior art example of a nose hair trimmer. The nose hair trimmer includes an outer blade, which is cylindrical and suitable for insertion into a nostril, and an inner blade, which is accommodated in the outer blade. The inner blade is driven and rotated by a drive source. The nose hair trimmer clips nose hair between the stationary outer blade and the rotating inner blade. In such a nose hair trimmer, the outer blade includes a side wall having an upper part that is bent and curved inward. Slits extend from the curved upper end of the outer blade toward the side wall to form a plurality of teeth, which have cutting edges. The inner blade includes cutting edges corresponding to the cutting edges of the outer blade. The inner blade rotates and slides along the inner blade. This clips the user's nose hair, which are received in slits of the outer blade, between the cutting edges of the outer blade and the inner blade.

In the above-described nose hair trimmer, the outer blade and inner blade each have a curved upper portion. It is thus difficult for the upper portions of the outer blade and the inner blade to be bent (curved) in conformance with each other. This increases interference between the outer blade and inner blade and produces a loud noise. It is thus desirable that the noise be reduced.

SUMMARY

It is an object of the present invention to provide a hair remover that is quiet.

One aspect of the present invention is a hair remover including a cylindrical outer blade including a side wall, a bend, and an upper wall that are continuous with each other. A first cutting edge is arranged on the upper wall and the side wall. An inner blade is rotatably accommodated in the outer blade. The inner blade includes a second cutting edge arranged so as to clip hair in cooperation with the first cutting edge of the outer blade. A relief is arranged on at least either one of the inner blade and the outer blade to prevent contact between the inner blade and the bend of the outer blade.

Other aspects and advantages of the present invention will become apparent from the following description, taken in conjunction with the accompanying drawings, illustrating by way of example the principles of the invention.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale. In the drawings, like numerals are used for like elements throughout.

DETAILED DESCRIPTION OF THE EMBODIMENTS

A hair remover according to one embodiment of the present invention will now be discussed with reference to the drawings.

Figure 1A:
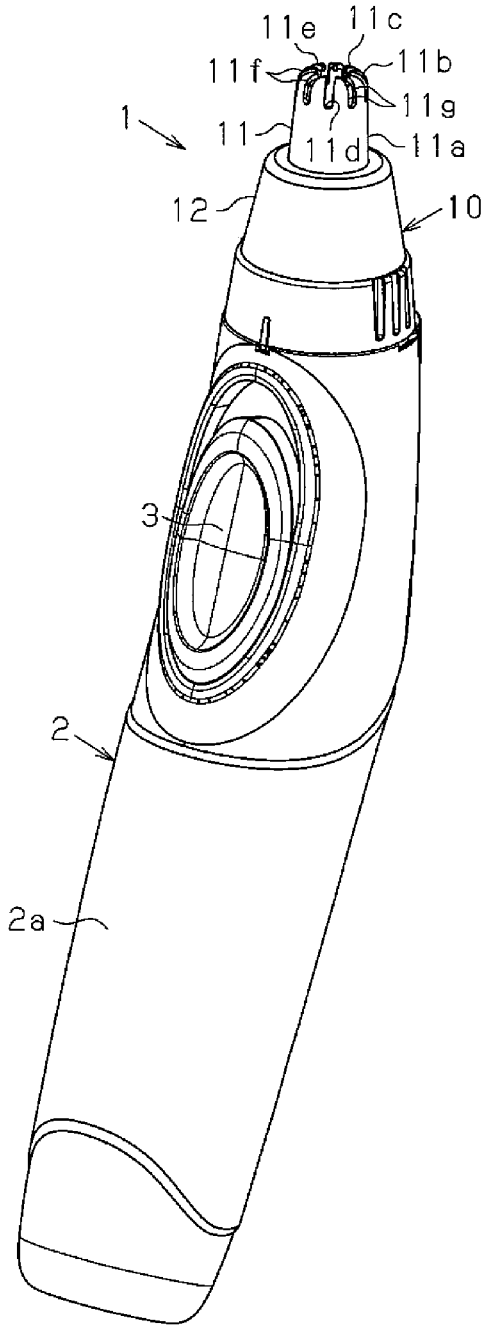
FIGS. 1A and 1B are perspective views showing a nose hair trimmer that serves as a hair remover according to one embodiment.
Figure 1B:
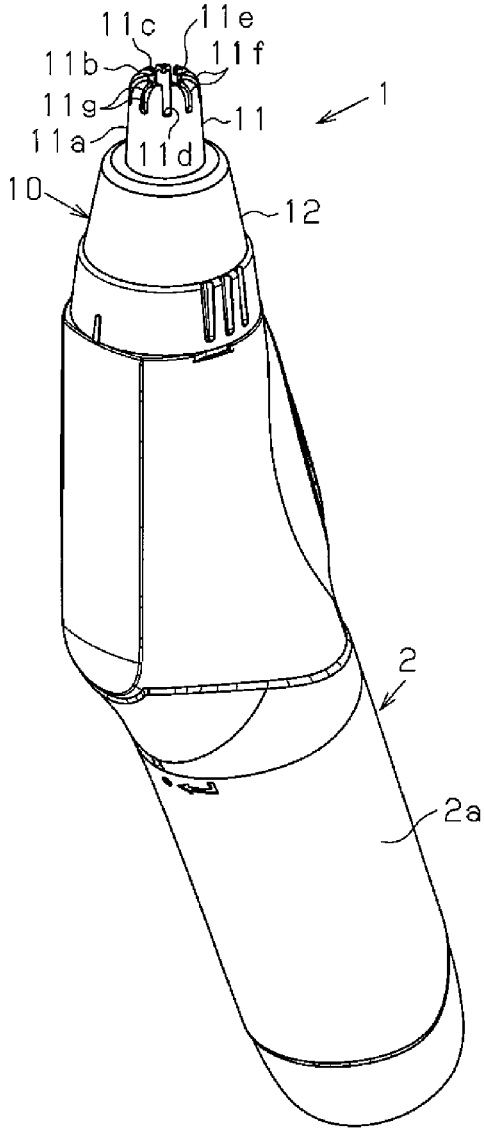
Figure 3:
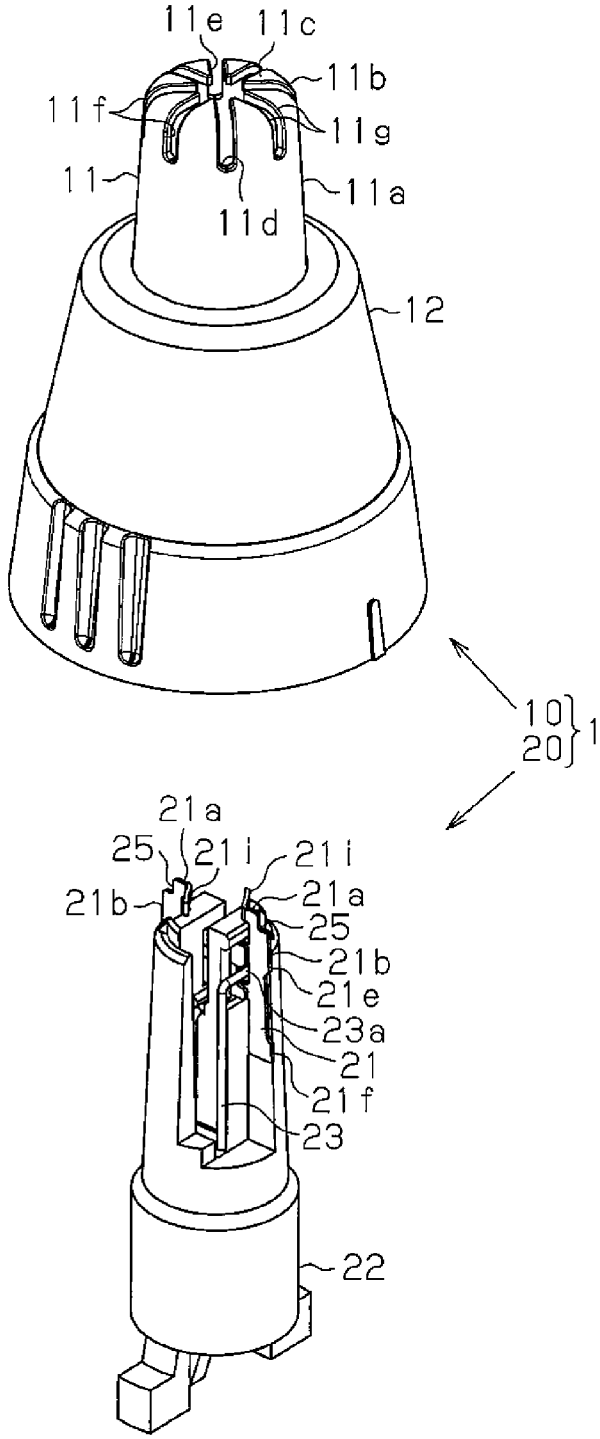
FIG. 3 is a perspective view showing an outer blade block and inner blade block of the nose hair trimmer of FIGS. 1A and 1B.

FIGS. 1A and 1B show a nose hair trimmer that serves as a hair remover. The nose hair trimmer has an overall cylindrical shape and includes a blade unit 1 and a main body 2, which is coupled to the bottom end of the blade unit 1. As shown in FIG. 3, the blade unit 1 includes an outer blade block 10 and an inner blade block 20, which is inserted into the outer blade block 10.

The main body 2 has a lower part defining a handle 2*a*. A switch 3 is arranged in the upper side of the handle 2*a* and operated by a user to activate and deactivate the nose hair trimmer. The blade unit 1 and the part of the main body 2 located above the handle 2*a* are inclined relative to the handle 2*a*. This shape allows for a user to easily insert the outer blade 11 into the nostril while holding the handle 2*a* upright.

Figure 2:
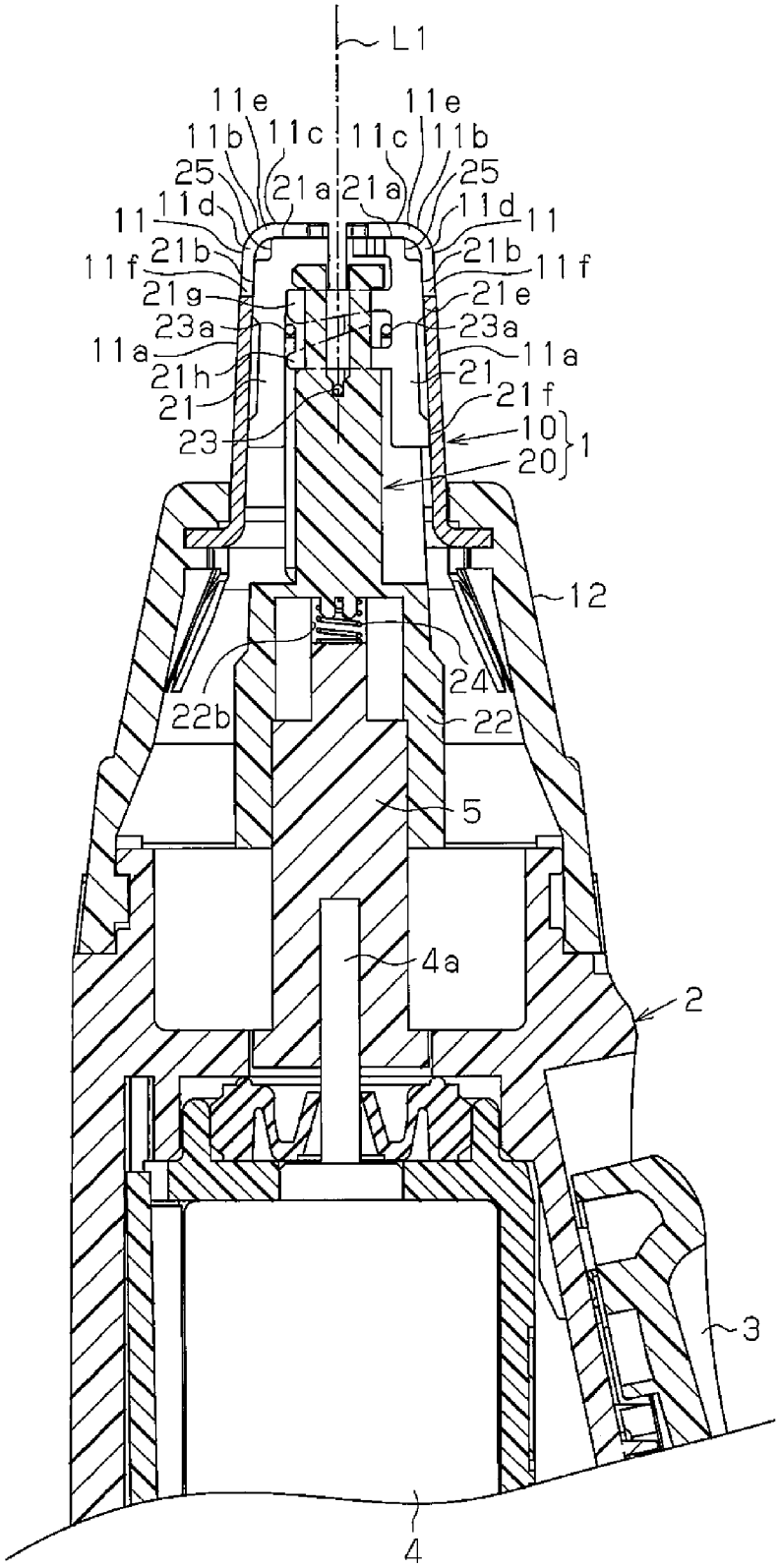
FIG. 2 is a cross-sectional view showing the nose hair trimmer of FIGS. 1A and 1B.

Referring to FIG. 2, a motor 4 is accommodated in the main body 2 near the switch 3. The motor 4 includes a motor shaft 4*a*, which is coupled by a joint 5 to the inner blade block 20. When the switch 3 is turned on, a battery (not shown), which is accommodated in the handle 2*a* at the lower part of the main body 2, drives the motor 4. When the motor 4 is driven, the motor shaft 4*a* and joint 5 rotate the inner blade block 20. In this manner, the blade unit 1 clips the user's nose hair (body hair).

Figure 4:
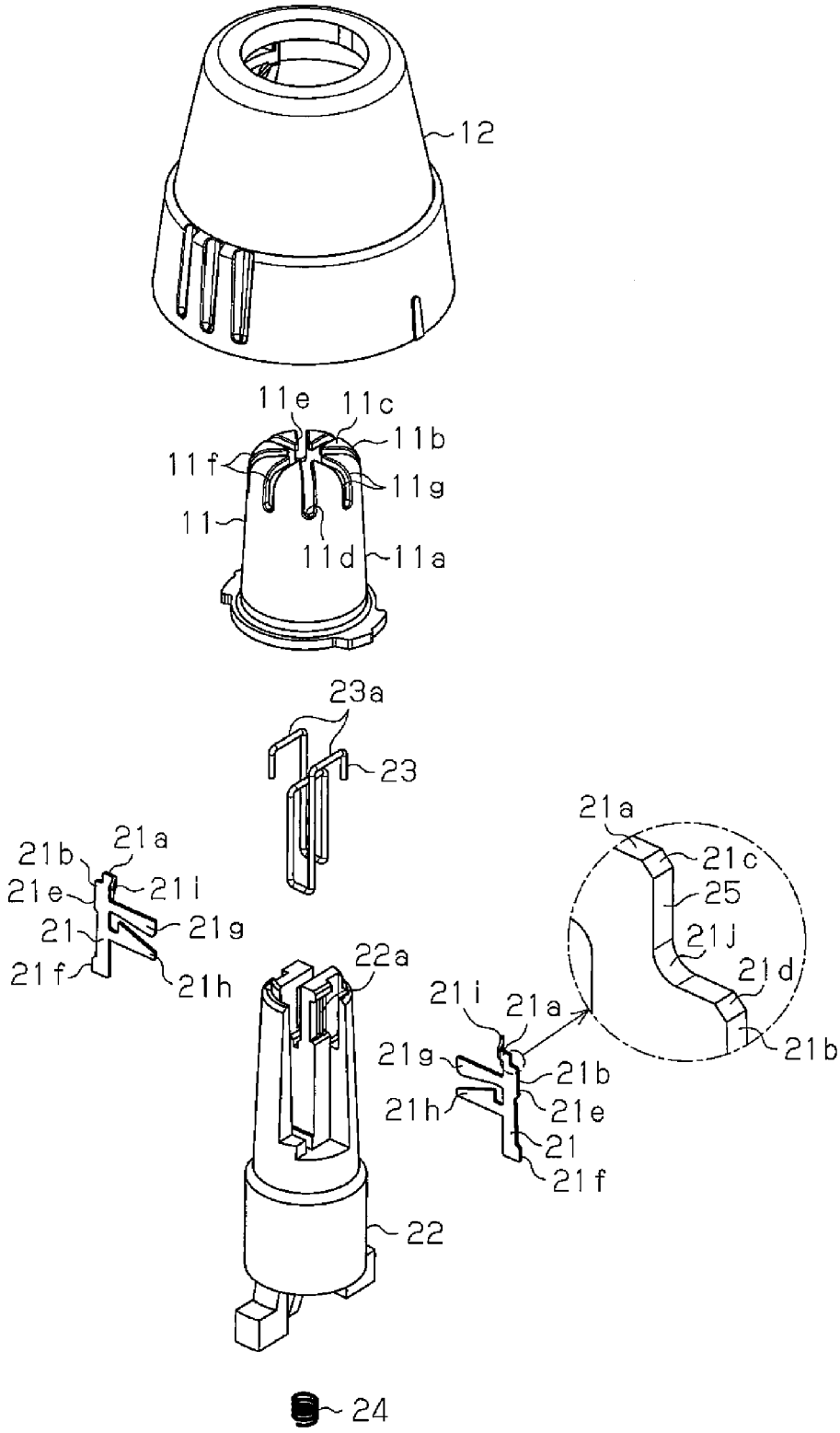
FIG. 4 is an exploded perspective view showing the blade blocks of FIG. 3.
Figure 6:
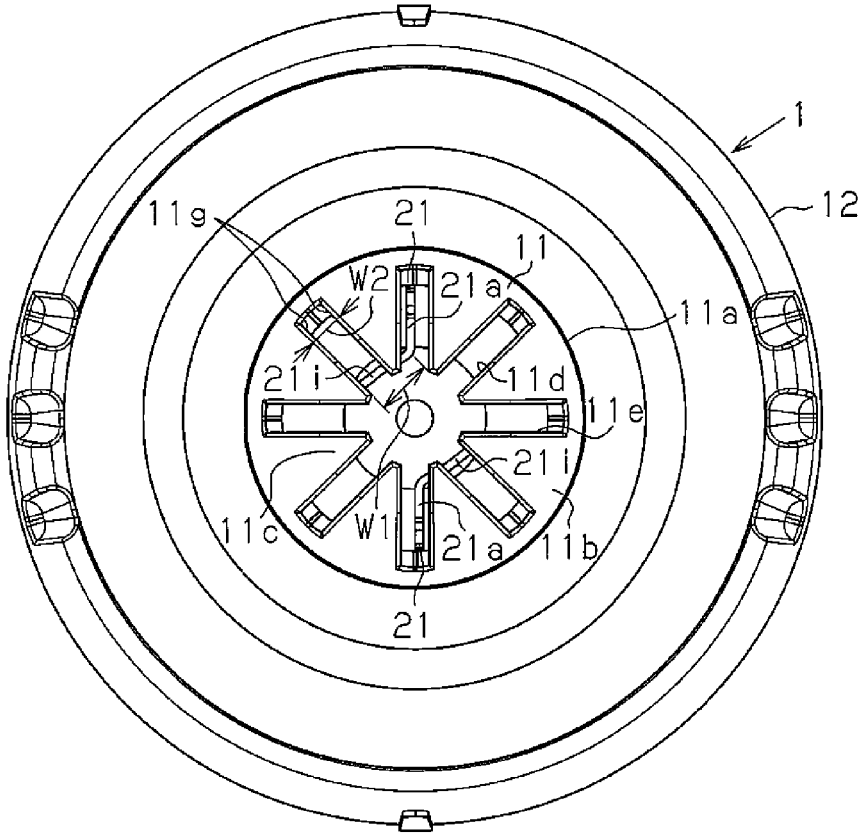
FIG. 6 is a plan view of the blade blocks of FIG. 3.

Referring to FIGS. 3 and 4, the outer blade block 10 includes an outer blade 11, which is substantially cylindrical, and an outer blade frame 12, which is hollow and substantially shaped as a truncated cone. The outer blade 11 has a side wall 11*a* (cylindrical wall), a bend 11*b*, which is continuous with the side wall 11*a* and bent inward so as to be curved, and an upper wall 11*c*, which is continuous with the bend 11*b*. The upper wall 11*c* closes one open end of the side wall 11*a*. The outer blade 11 further includes eight slits lid (refer to FIG. 6), which extend from the upper wall 11*c* via the bend 11*b* and to the side wall 11*a*. The slits 11*d* are arranged at equal angular intervals along a circumferential direction of the outer blade 11. The outer blade frame 12 has an upper end, which holds the bottom of the outer blade 11, and a lower end, which is attached to the main body 2 in a removable manner.

Figure 5:
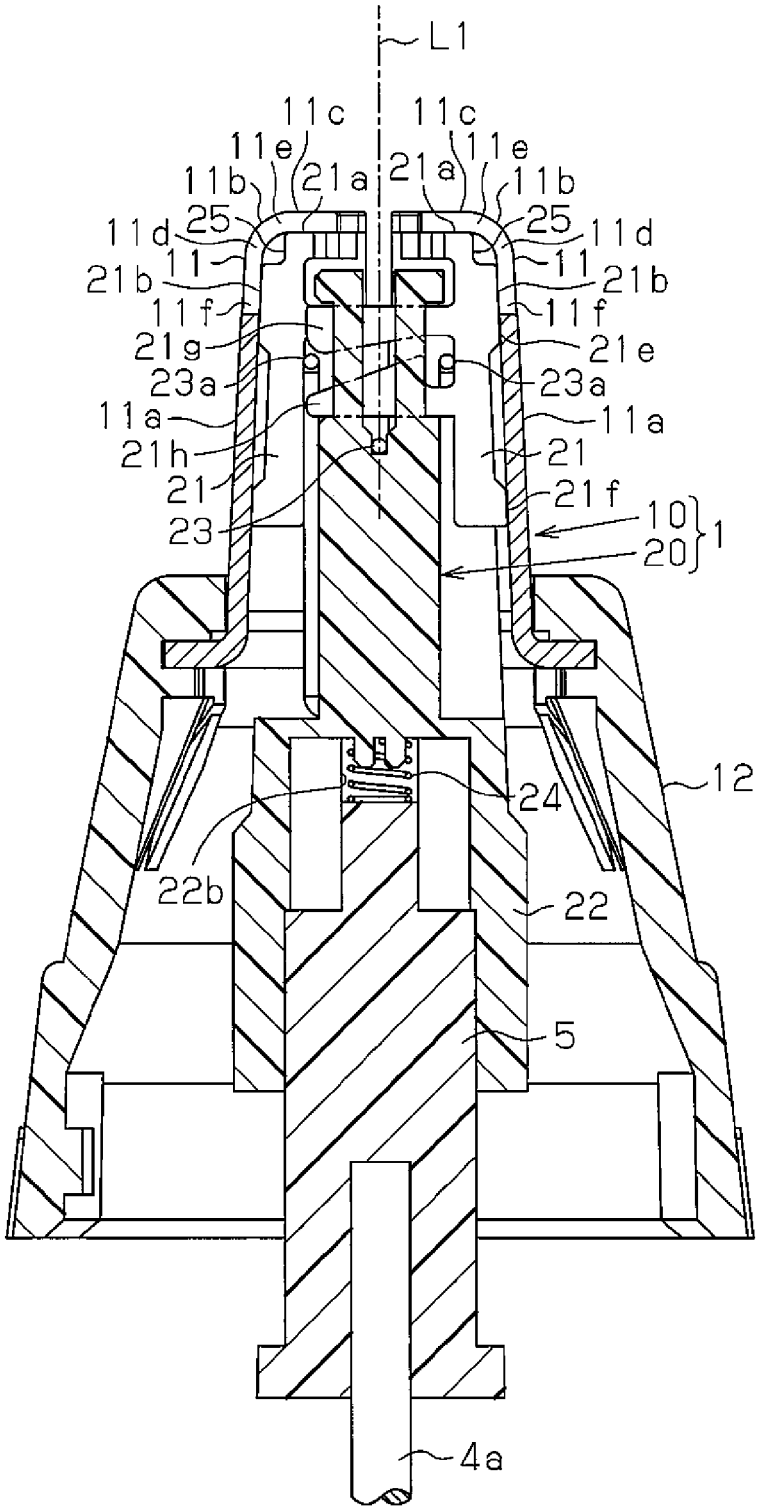
FIG. 5 is an enlarged cross-sectional view of the blade blocks of FIG. 3.

As shown in FIGS. 3 to 5, the inner blade block 20 includes inner blades 21 (in the illustrated embodiment, two inner blades 21), an inner blade frame 22, which holds the inner blades 21, a sideward pushing spring 23, which pushes the inner blades 21 against the side wall 11*a* of the outer blade 11, and an upward pushing spring 24, which pushes the inner blade 21 against the upper wall 11*c* of the outer blade 11. The number of the inner blades 21 is not limited to two and there may just one inner blade 21. Alternatively, there may be three or more inner blades 21.

As shown in FIG. 5, in the outer blade 11, the slits lid form upper cutting edges lie in the upper wall 11*c* and side cutting edges 11*f* in the side wall 11*a*. The bend 11*b* is located between the upper cutting edges lie and the side cutting edges 11*f*. The outer blade 11 cooperates with the inner blades 21 to clip nose hair that is received in the slits 11*d*. Each of the upper cutting edges lie and side cutting edges 11*f* are straight. That is, the upper cutting edges 11*e* extend straight and orthogonal to the rotation axis L1 of the inner blade block 20 (motor 4). This facilitates formation of the outer blade 11. As shown in FIGS. 3 and 4, the upper cutting edges 11*e* and side cutting edges 11*f* have outer rims 11*g* that are preferably chamfered. The chamfering allows for smooth insertion of the outer blade 11 into the nostril.

Figure 7:
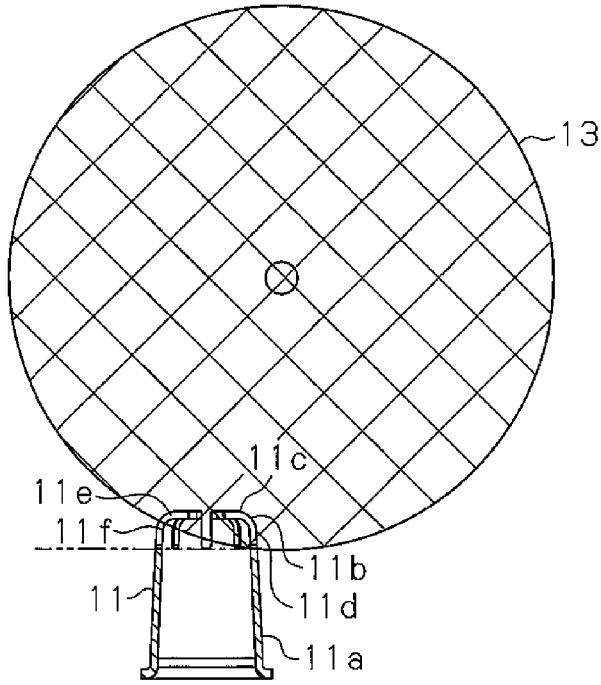
FIG. 7 is a schematic diagram illustrating a process for forming slits in the outer blade of FIG. 3.

In the illustrated example, the outer blade 11 has eight slits 11*d*. When there are eight slits 11*d*, this ensures that the slits 11*d* have a width W2 that is suitable for receiving nose hair (refer to FIG. 6), while the outer blade 11 is held with its diameter remaining suitable for insertion into a user's nostril. Thus, nose hair is effectively clipped when there are eight slits 11*d*. In addition, as shown in FIG. 7, when the outer blade 11 has an even number of slits 11*d* arranged at equal angular intervals, a disk-shaped grindstone 13 may be moved past the center of the circular upper wall 11*c* of the outer blade 11, which is cylindrical. This allows for two slits 11*d* to be formed at the same time during a single passage of the grindstone 13 and thus shortens the formation time of the slits 11*d*.

As shown in FIG. 4, the inner blade 21 may be planar. The inner blade 21 includes an upper cutting edge 21*a*, which corresponds to the upper cutting edges 11*e* of the outer blade 11, and a side cutting edge 21*b*, which corresponds to the side cutting edges 11*f* of the outer blade 11. Each of the upper cutting edge 21*a* and the side cutting edge 21*b* is straight. When the motor 4 drives and rotates the inner blade block 20, the upper cutting edges 11*e* of the outer blade 11 cooperate with the upper cutting edge 21*a* of the inner blade 21 and the side cutting edges 11*f* of the outer blade 11 cooperate with the side cutting edges 21*b* of the inner blade 21 to clip the nose hair received in the slits 11*d*. The straight cutting edges 11*e*, 11*f*, 21*a*, and 21*b* allow for the shapes of the outer blade 11 and the inner blade 21 to be in conformance more easily than when they are curved. This decreases interference between the outer blade 11 and the inner blade 21 that would be caused when the outer blade 11 and inner blade 21 are not shaped in conformance. Further, the production of noise is suppressed. In addition, the pressure applied by the inner blade 21 to the outer blade 11 becomes stable and allows for satisfactory clipping of nose hair. This improves clipping capability.

The upper cutting edge 21*a* of the inner blade 21 extends straight and orthogonal to the rotation axis L1 of the inner blade block 20. The straight upper cutting edge 21*a* facilitates formation of the inner blade 21 and simplifies contact of the inner blade 21 with the outer blade 11.

The inner blade 21 includes a substantially tetragonal cut-out portion, or relief 25, at a location corresponding to the bend 11*b* of the outer blade 11. Due to the relief 25, the outer blade 11 and inner blade 21 do not contact each other at curved portions. This effectively suppresses the production of noise and prevents incomplete clipping of the nose hair that may occur at curved portions.

As shown in FIG. 4, a corner 21*c*, which is formed between the relief 25 and the upper cutting edge 21*a*, and a corner 21*d*, which is formed between the relief 25 and the side cutting edge 21*b*, are both chamfered. When the inner blade 21 is inserted into the outer blade 11, the chamfered corners 21*c* and 21*d* prevent the side cutting edge 21*b* of the inner blade 21 from getting caught in the side wall 11*a* of the outer blade 11. This facilitates the insertion of the inner blade 21 into the outer blade 11. Dimensional errors in the inner blade 21 and outer blade 11 may cause the upper cutting edge 21*a* or side cutting edge 21*b* of the inner blade 21 to project relatively out of the curved bend 11*b* of the outer blade 11. Even in such a case, the chamfered corners 21*c* and 21*d* suppress interference between the bend 11*b* and the cutting edges 21*a* and 21*b* and minimize the influence of dimensional errors in the inner blade 21 and outer blade 11.

A corner 21*j* in the relief 25 is curved. This increases the strength of the corner 21*j* and prevents deformation and damage of the inner blade 21.

The inner blade 21 further includes side sliding portions 21*e* and 21*f* facing toward the side wall 11*a* of the outer blade 11. The side sliding portion 21*e* is continuous with the side cutting edge 21*b*, and the side sliding portion 21*f* is spaced apart by a predetermined distance from the side sliding portion 21*e*. The inner blade 21 includes an upper arm 21*g* and a lower arm 21*h*, which project in a direction opposite to the side cutting edge 21*b*. The upper arm 21*g* and the lower arm 21*h* are fitted into an inner blade fitting hole 22*a* formed in the inner blade frame 22. The sideward pushing spring 23, which is formed by a single wire spring, is mounted on the inner blade frame 22. The sideward pushing spring 23 has an abutment portion 23*a*, which abuts against the inner blade 21. The elastic force of the sideward pushing spring 23 pushes the inner blade 21 outward in the radial direction against the inner surface of the side wall 11*a* of the outer blade 11. Thus, as the inner blade 21 receives the elastic force of the sideward pushing spring 23, the two side sliding portions 21*e* and 21*f* slide along the inner surface of the outer blade 11. In this manner, the inner blade 21 stably slides along the side wall 11*a* of the outer blade 11 while preventing the side cutting edge 21*b* from projecting into the slits 11*d*.

As shown in FIGS. 3 and 4, the upper part of the inner blade 21 includes a bent piece 21*i*, which is bent in the circumferential direction so as to intersect the radial direction. The bent piece 21*i* has a width W1 (refer to FIG. 6) in the circumferential direction that is set to be greater than the width W2 of the slits 11*d* of the outer blade 11. The upward pushing spring 24, which is a coil spring, is accommodated in a lower cavity 22*b* (refer to FIG. 5) of the inner blade frame 22. Thus, the upward pushing spring 24 is arranged between the inner blade frame 22 and the joint 5. The elastic force of the upward pushing spring 24 pushes the inner blade 21 in the upper direction against the inner surface of the upper wall 11*c* of the outer blade 11. Thus, as the inner blade 21 receives the elastic force of the upward pushing spring 24, the bent piece 21*i* slides along the inner surface of the upper wall 11*c* of the outer blade 11. In this manner, the inner blade 21 slides along the upper wall 11*c* of the outer blade 11, while preventing the upper cutting edges 21*a* from projecting into the slits 11*d*.

In this manner, the outer blade block 10 and the inner blade block 20 form the blade unit 1 of the nose hair trimmer according to the present embodiment. This clips nose hair with the outer blade 11 and the inner blade 21 in a satisfactory manner.

The present embodiment has the advantages described below.

(1) The outer blade 11 that is cylindrical includes the side wall 11*a*, the upper wall 11*c*, and the curved bend 11*b*, which connects the side wall 11*a* and the upper wall 11*c*. The side wall 11*a* serves as the circumferential wall. The upper wall 11*c* closes one open end of the cylindrical outer blade 11 and is bent inward from the side wall 11*a* via the curved bend 11*b*. The outer blade 11 further includes the upper cutting edges 11*e* formed in the upper wall 11*c* and the side cutting edges 11*f* formed in the side wall 11*a*. Each inner blade 21 includes the upper cutting edge 21*a*, which corresponds to the upper cutting edges 11*e* of the outer blade 11, and the side cutting edge 21*b*, which corresponds to the side cutting edges 11*f* of the outer blade 11. Further, each inner blade 21 includes the relief 25, which is arranged at a location corresponding to the curved bend 11*b* of the outer blade 11. Accordingly, the inner blades 21 and the outer blade 11 do not contact each other at the bend 11*b* of the outer blade 11, which is difficult to be shaped in conformance with the inner blades 21. This minimizes interference between the outer blade 11 and the inner blades 21 and effectively suppresses the production of noise.

(2) The upper cutting edge 11*e* and the side cutting edge 11*f* of the outer blade 11 are each formed to be straight. In addition, the upper cutting edge 21*a* and the side cutting edge 21*b* of each inner blade 21 are also formed to be straight. In other words, the outer blade 11 and the inner blades 21 include the straight side cutting edges 11*f* and 21*b* and the straight upper cutting edges 11*e* and 21*a*. Accordingly, the surfaces of the outer blade 11 and the inner blades 21 that contact and slide along one another are straight. The straight surfaces allow for the outer blade 11 and the inner blade 21 to be shaped in conformance with each more easily than when they are curved. This minimizes interference between the outer blade 11 and the inner blades 21 and effectively suppresses the production of noise. This also stabilizes the force applied by the inner blades 21 to the outer blade 11. Thus, nose hair is clipped in a satisfactory manner, and the clipping capability is improved.

(3) The relief 25 is a tetragonal cutout portion formed at a location in each inner blade 21 facing toward the curved bend 11*b* of the outer blade 11. Thus, noise may be suppressed just by slightly changing the shape of the inner blade 21.

(4) Each inner blade 21 includes the corner 21*c*, which is arranged between the relief 25 and the upper cutting edge 21*a*, and the corner 21*d*, which is arranged between the relief 25 and the side cutting edge 21*b*. Thus, when the inner blade 21 is inserted into the outer blade 11, the corners 21*c* and 21*d* prevent the side cutting edges 21*b* of the inner blades 21 from getting caught in the side wall 11*a* of the outer blade 11. This facilitates the insertion of the inner blade 21 into the outer blade 11. Further, the corners 21*c* and 21*d* are chamfered. Thus, even when dimensional errors in the inner blade 21 and outer blade 11 cause the upper cutting edges 21*a* or side cutting edges 21*b* of the inner blades 21 to project relatively out of the curved bend 11*b* of the outer blade 11, the chamfered corners 21*c* and 21*d* suppress interference between the bend 11*b* and the cutting edges 21*a* and 21*b* and minimize the influence of dimensional errors in the inner blade 21 and outer blade 11.

(5) The width W1 of the bent piece 21*i* formed on the upper part of each inner blade 21 is greater than the width W2 of the slits 11*d* of the outer blade 11. This prevents the upper cutting edges 21*a* of the inner blades 21 from projecting into the slits 11*d* and thereby prevents damaging of the inner blades 21 and the like. Further, the bent piece 21*i* may easily be formed by just bending part of the corresponding inner blade 21.

(6) The outer blade 11 includes the eight slits 11*d* (an even number), which are arranged at equal angular intervals. Thus, by moving the grindstone 13 past the center of the circular upper wall 11*c* of the outer blade 11, which is cylindrical, two slits 11*d* may be formed at the same time. This facilitates the formation of the slits 11*d*. When an odd number of slits 11*d* are provided, the slits 11*d* are formed one at a time. Thus, the even number of slits 11*d*, which are arranged at equal angular intervals, allows for the slits 11*d* to be formed within a short period of time. In particular, when there are eight slits 11*d*, this ensures that the slits 11*d* have the width W2 that is suitable for receiving nose hair, while the outer blade 11 is held with its diameter remaining suitable for insertion into a user's nostril. Thus, nose hair is further effectively clipped when there are eight slits 11*d*.

(7) In the outer blade 11 and the inner blades 21, each of the upper cutting edges 11*e* and 21*a* are formed to extend straight and orthogonal to the rotation axis L1 of the inner blades 21. This facilitates formation of the outer blade 11 and the inner blade 21 and allows for uniform contact of the inner blade 21 with the outer blade 11.

The present examples and embodiments are to be considered as illustrative and not restrictive, and the invention is not to be limited to the details given herein, but may be modified within the scope and equivalence of the appended claims.

Figure 8:
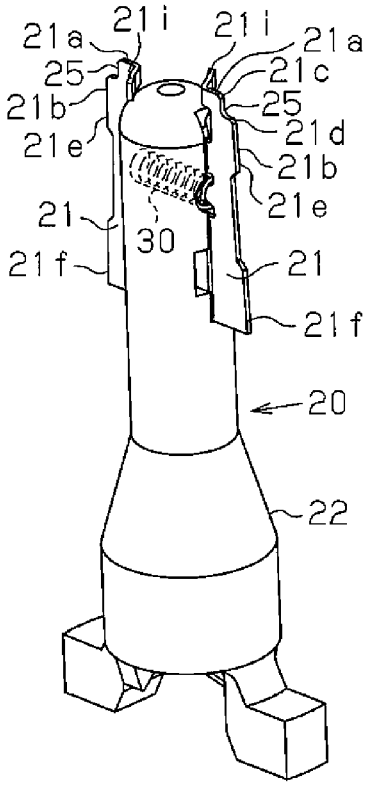
FIG. 8 is a perspective view showing a first modification of the inner blade block.

In the above-discussed embodiment, the sideward pushing spring 23, which is formed by a single wire spring, pushes the inner blades 21 against the side wall 11*a* of the outer blade 11. However, the means for urging the inner blades 21 is not limited to the sideward pushing spring 23. For example, as shown in FIG. 8, a typical coil spring 30 may be used to push the inner blades 21 against the side wall 11*a* of the outer blade 11.

Figure 9:
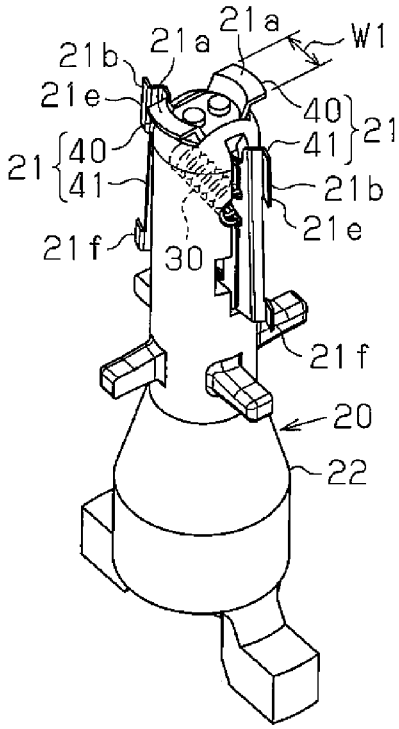
FIG. 9 is a perspective view showing a second modification of the inner blade block.

In the above-discussed embodiment, the upper cutting edge 21*a* and side cutting edge 21*b* are each formed integrally with the corresponding inner blade 21. Instead, for example, as shown in FIG. 9, each inner blade 21 may include an upper inner blade 40, which includes the upper cutting edge 21*a*, and a side inner blade 41, which includes the side cutting edge 21*b*. In this case, the upper cutting edge 21*a* and the side cutting edge 21*b* are formed by discrete bodies. Thus, in comparison to when the upper cutting edge 21*a* and the side cutting edge 21*b* are formed integrally with the corresponding inner blade 21, the influence of differences in the dimensions and shapes of the upper cutting edges 21*a* and the side cutting edges 21*b* is minimized. As a result, the inner blades 21 slide in a preferable manner along the outer blade 11. Further, in this structure, the width W1 of the upper part (upper cutting edge 21*a*) of the inner blade 21 is greater than the width W2 of the slits 11*d* in the outer blade 11. This prevents the upper cutting edges 21*a* of the inner blades 21 from projecting into the slits 11*d* of the outer blade 11 and thereby prevents damaging of the inner blades 21 and the like.

Figure 10A:
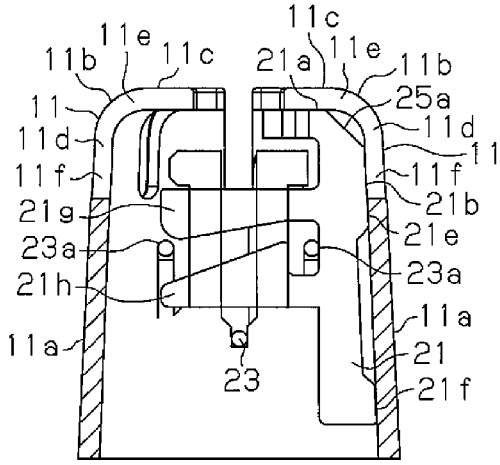
FIGS. 10A to 10D are cross-sectional diagrams showing reliefs in different modifications.
Figure 10B:
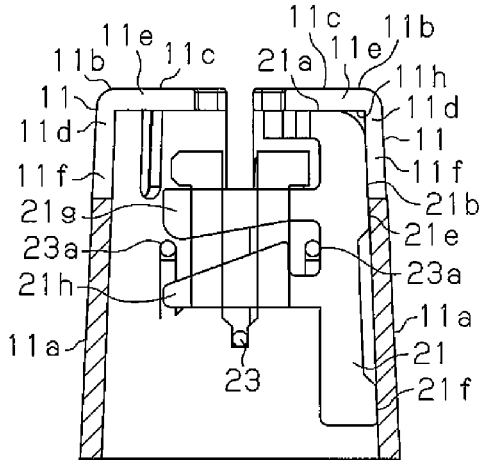
Figure 10C:
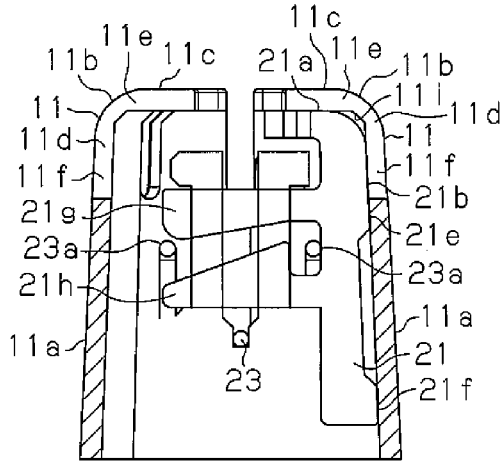
Figure 10D:
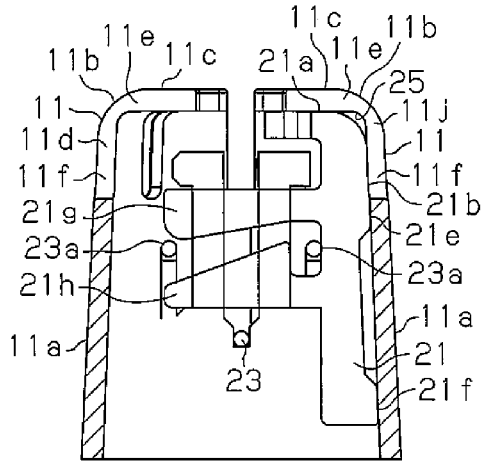

In the above-discussed embodiment, the inner blade 21 includes a tetragonal cutout portion that forms the relief 25. However, as shown in FIG. 10A, for example, the portion in the inner blade 21 that corresponds to the bend 11*b* of the outer blade may be beveled to form a relief 25*a*. Further, as shown in FIGS. 10B to 10D, the portion of the inner blade 21 between the upper cutting edge 21*a* and side cutting edge 21*b* may be curved. In this case, the portion in the outer blade 11 between the upper wall 11*c* and the side wall 11*a* may be orthogonal, trapezoidal, or thinned so as to form a relief 11*h*, a relief 11*i*, or a relief 11*j*. Alternatively, the inner blade 21 and the outer blade 11 may both include a relief.

In the above-discussed embodiment, the structure and shape of the inner blade 21 and outer blade 11 may be changed as required.

In the above-discussed embodiment, the outer blade 11 includes eight slits 11*d*. However, the outer blade 11 may include any other number of slits 11*d* although it is desirable that there be an even number of slits 11*d* to facilitate formation.

Although not particularly mentioned above, the battery may be a primary battery, such as a dry cell, or a rechargeable secondary battery.

The present examples and embodiments are to be considered as illustrative and not restrictive, and the invention is not to be limited to the details given herein, but may be modified within the scope and equivalence of the appended claims.

What is claimed is:

1. A hair remover comprising:

a cylindrical outer blade including a side wall, a bend, and an upper wall that are continuous with each other, in which a first cutting edge is arranged on the upper wall and the side wall;

an inner blade rotatably accommodated in the outer blade, the inner blade including a second cutting edge arranged so as to clip hair in cooperation with the first cutting edge of the outer blade; and a relief arranged on at least either one of the inner blade and the outer blade to prevent contact between the inner blade and the bend of the outer blade, wherein:

the first cutting edge of the outer blade includes a straight side cutting edge and a straight upper cutting edge;

the second cutting edge of the inner blade includes a straight side cutting edge and a straight upper cutting edge;

the relief is formed by a cutout portion arranged in the inner blade at a location corresponding to the bend of the outer blade; and the inner blade includes a first corner, which is formed between the relief and the upper cutting edge of the inner blade, and a second corner, which is formed between the relief and the side cutting edge of the inner blade, with the first corner and the second corner each being chamfered.

2. The hair remover according to claim 1, wherein the first cutting edge and the second cutting edge each include a straight contact surface that contacts the contact surface of the other one of the first cutting edge and the second cutting edge.

3. The hair remover according to claim 1, wherein the relief is a tetragonal or beveled cutout.

4. The hair remover according to claim 1, wherein the relief is defined by the bend of the outer blade that is bent to be orthogonal or trapezoidal.

5. The hair remover according to claim 1, wherein the relief is defined by the bend of the outer blade formed to be thinner than the upper wall and the side wall of the outer blade.

6. The hair remover according to claim 1, wherein the outer blade includes a slit forming the first cutting edge, with the slit having a predetermined width; and the inner blade includes a bent piece bent so as to extend from the inner blade in a direction that intersects the direction the slit extends, with the bent piece having a width that is greater than the width of the slit.

7. The hair remover according to claim 1, wherein the upper cutting edge of the inner blade is discrete from the side cutting edge of the inner blade.

8. The hair remover according to claim 1, wherein the outer blade includes slits forming the first cutting edge, with an even number of the slits being arranged at equal angular intervals.

9. A hair remover comprising:

a cylindrical outer blade including a side wall, a bend, and an upper wall that are continuous with each other in which a first cutting edge is arranged on the upper wall and the side all;

an inner blade rotatably accommodated in the outer blade, the inner blade including a second cutting edge arranged so as to clip hair in cooperation with the first cutting edge of the outer blade; and a relief arranged on at least either one of the inner blade and the outer blade to prevent contact between the inner blade and the bend of the outer blade, wherein the relief is defined by the bend of the outer blade that is bent to the orthogonal or trapezoidal, and the inner blade includes a curved portion facing toward the orthogonal or trapezoidal bend.

10. A hair remover comprising:

a cylindrical outer blade including a side wall, a bend, and an upper wall that are continuous with each other, in which a first cutting edge is arranged on the upper wall and what side wall;

an inner blade rotatably accommodated in the outer blade, the inner blade including a second cutting edge arranged so as to clip hair in cooperation with the first cutting edge of the outer blade; and a relief arranged on at least either one of the inner blade and the outer blade to prevent contact between the inner blade and the bend of the outer blade, wherein the relief is defined by the bend of the outer blade formed to be thinner than the upper wall and the side wall of the outer blade, and the inner blade includes a curved portion facing toward the thin bend.

11. A hair remover comprising:

a cylindrical outer blade including a side wall, a bend, and an upper wall that are continuous with each other, in which a first cutting edge is arranged on the upper wall and the side wall;

an inner blade rotatably accommodated in the outer blade, the inner blade including a second cutting edge arranged so as to clip hair in cooperation with the first cutting edge of the outer blade; and a relief arranged on at least either one of the inner blade and the outer blade to prevent contact between the inner blade and the bend of the outer blade, wherein the outer blade includes a slit forming the first cutting edge, with the slit having a predetermined width; and the inner blade includes a bent piece bent so as to extend from the inner blade in a direction that intersects the direction the slit extends, with the bent piece having a width that is greater than the width of the slit.

* * * * *